US010594022B2

(12) United States Patent
Oh et al.

(10) Patent No.: US 10,594,022 B2
(45) Date of Patent: Mar. 17, 2020

(54) TRIBAND ANTENNA

(71) Applicant: Hewlett-Packard Development Company, L.P., Houston, TX (US)

(72) Inventors: Sung Oh, Palo Alto, CA (US); Philip Wright, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/772,075

(22) PCT Filed: Feb. 19, 2016

(86) PCT No.: PCT/US2016/018678

§ 371 (c)(1),
(2) Date: Apr. 30, 2018

(87) PCT Pub. No.: WO2017/142552

PCT Pub. Date: Aug. 24, 2017

(65) Prior Publication Data

US 2018/0342790 A1 Nov. 29, 2018

(51) Int. Cl.

| | |
|---|---|
| ***H01Q 1/38*** | (2006.01) |
| ***H01Q 1/24*** | (2006.01) |
| ***H01Q 5/378*** | (2015.01) |
| ***H01Q 9/42*** | (2006.01) |
| ***H01Q 5/357*** | (2015.01) |
| ***H01Q 7/00*** | (2006.01) |

(52) U.S. Cl.

CPC ..... *H01Q 1/243* (2013.01); *H01Q 1/38* (2013.01); *H01Q 5/357* (2015.01); *H01Q 5/378* (2015.01); *H01Q 7/00* (2013.01); *H01Q 9/42* (2013.01)

(58) Field of Classification Search

CPC ..... H01Q 1/243; H01Q 5/357; H01Q 1/38; H01Q 7/00

See application file for complete search history.

(56) References Cited

U.S. PATENT DOCUMENTS

| | | | |
|---|---|---|---|
| 9,197,270 | B2 | 11/2015 | Ying et al. |
| 2005/0110692 | A1 | 5/2005 | Andersson |
| 2012/0262345 | A1 | 10/2012 | Kim et al. |

(Continued)

FOREIGN PATENT DOCUMENTS

| | | | |
|---|---|---|---|
| CN | 103811864 | A | 5/2014 |
| TW | 201431179 | A | 8/2014 |
| WO | WO-2013033958 | A1 | 3/2013 |

OTHER PUBLICATIONS

Hsiao, F.R. et al, "Dual-band Slot Antenna Suitable for Ultrabook Application with Metal Housing", Dec. 2-5, 2014.

*Primary Examiner* — Graham P Smith
(74) *Attorney, Agent, or Firm* — Brooks Cameron & Huebsch PLLC (US LC)—USD

(57) ABSTRACT

Example implementations relate to a triband antenna. In one example, a triband antenna system as described herein can include a grounding system including a conductive housing of a wireless communication device and a ground slot structure. The triband antenna system may further include a triband antenna coupled to the grounding system, wherein the triband antenna includes a loop element coupled to the conductive housing, a feeding element, and a parasitic element located within a threshold distance of the feeding element.

13 Claims, 3 Drawing Sheets

(56) References Cited

U.S. PATENT DOCUMENTS

| | | | | |
|---|---|---|---|---|
| 2012/0319906 | A1 | 12/2012 | Hikino et al. | |
| 2013/0135157 | A1 | 5/2013 | Tsou | |
| 2013/0169490 | A1 | 7/2013 | Pascolini et al. | |
| 2013/0257659 | A1 | 10/2013 | Darnell et al. | |
| 2014/0274231 | A1 | 9/2014 | DeLuis et al. | |
| 2015/0002350 | A1 | 1/2015 | Vance et al. | |
| 2015/0145734 | A1 | 5/2015 | Caballero et al. | |
| 2015/0244061 | A1 | 8/2015 | Galeev | |
| 2015/0333390 | A1* | 11/2015 | Peng | H01Q 1/243 343/702 |

* cited by examiner

TRIBAND ANTENNA

BACKGROUND

Computing devices can include antennae to facilitate wireless communication. For example, a plurality of antennae in a computing device may be designated to operate in different frequency bands of interest to the device, while still maintaining signal strength and minimizing size requirements for the device.

DETAILED DESCRIPTION

Figure 1:
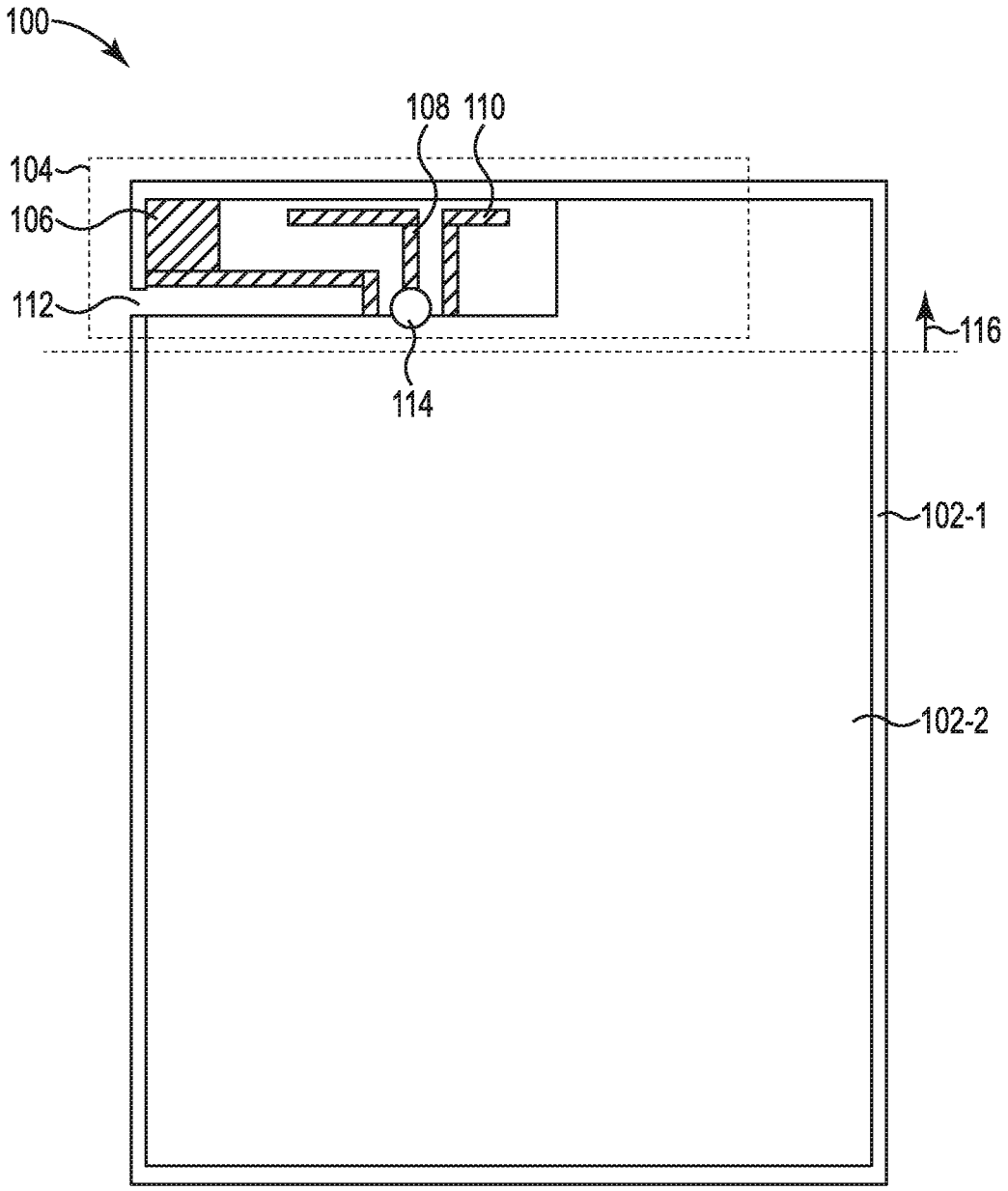
FIG. 1 illustrates a diagram of an example of a system according to the disclosure.

As computing device specifications change, space allocation within computing devices may change. For example, mobile and/or portable computing devices (referred to generally herein as "computing devices") may become smaller, thinner, and/or lighter. Computing devices can include smartphones, handheld computers, personal digital assistants, carputers, wearable computers, laptops, tablet computers, laptop/tablet hybrids, etc.

Computing devices can include an antenna to send and/or receive signals. For example, an antenna can be used to facilitate web access, voice over IP, gaming, high-definition mobile television, video conferencing, etc. However, as computing devices become smaller, thinner, and/or lighter multiple antennae of an electronic device may be positioned comparatively closer to each other. An antenna may experience interference and/or may not perform as desired when positioned near and/or in contact with another antenna. Also, wireless communication devices such as smartphones and tablet devices may include conductive cosmetic features such as metal bands around the perimeter of the device housing. While providing an attractive appearance, such conductive cosmetic features may cause interference with the device's antenna system.

Furthermore, designing a triband antenna may be challenging for a thin profile device having surrounded decorative metal parts. As used herein, a triband antenna refers to an antenna capable of receiving and transmitting radio frequency (RF) signals in at least three different bands, or frequencies. For example, a triband antenna as described herein may receive and transmit RF signals associated with global positioning services (GPS), 2.4 gigahertz (GHz) Wi-Fi signals, and/or 5 GHz Wi-Fi signals.

Accordingly, the disclosure is directed to methods, systems, and electronic devices employing a triband antenna. For example, a triband antenna apparatus as described herein can include a loop element of the triband antenna coupled to a conductive housing of a wireless communication device to generate a RF signal in a first frequency range. The triband antenna apparatus may include a feeding element directly coupled to a RF signal source to generate a RF signal in a second frequency range, and a parasitic element of the triband antenna located within a threshold distance of the feeding element to in part generate a RF signal in a third frequency range. As used herein, a loop element refers to an element of an antenna consisting of a loop or loops of conductive material. Also, as used herein, a feeding element refers to an element of an antenna which feed RF waves to the rest of the antenna structure and/or collects incoming radio waves and converts them to electric currents for transmission to a receiver. Last, as used herein, a parasitic element refers to an element of an antenna which does not have an independent electrical connection, but which is electromagnetically coupled to the feeding element by virtue of proximity to the feeding element.

FIG. 1 illustrates a diagram of an example of a system 100 according to the disclosure. FIG. 1 illustrates an example of a system 100 according to the disclosure. As illustrated in FIG. 1, the system 100 can include a grounding system 102 comprising a conductive housing 102-1, and a chassis ground 102-2. The system 100 may also include a triband antenna 104 including a loop element 106, a feeding element 108, a parasitic element 110, and a signal feed 114, among other components. Moreover, the system 100 may include a region referred to as a ground slot structure 116, which includes both conductive and non-conductive portions. The system 100 may be implemented in a wireless communication device such as a smartphone, handheld computer, personal digital assistant, carputer, wearable computer, laptop, tablet computer, and/or laptop/tablet hybrids, among others. While examples are provided herein of wireless communication devices, examples are not limited to those enumerated, and it is to be understood that the term wireless communication device may refer to any device capable of transferring information between two or more points that are not connected by an electrical conductor.

As used herein, a conductive housing refers to a metal band, enclosure, or other device to encase a wireless communication device. In some examples, the conductive housing 102-1 may refer to a decorative housing, such as a decorative metal band. Also, while metal is provided as an example of a conductive material, it is noted that examples are not so limited and the conductive housing 102-1 may be comprised of materials other than metal. As used herein, a ground slot structure refers to a portion of the wireless communication device that includes a triband antenna disposed at least in part in a specialized slot of a ground material. Put another way, a ground slot structure 116 refers to a ground material with a slot, where the slot includes at least part of a triband antenna.

As illustrated in FIG. 1, the loop element 106 may be coupled to the conductive housing 102-1. That is, the loop element 106 may be coupled to the conductive housing 102-1 such that the loop element 106, the conductive housing 102-1, and a portion of the chassis ground 102-2 form a loop antenna. Further, the parasitic element 110 may be located within a threshold distance of the feeding element 108. For instance, the parasitic element 110 may be located within a threshold distance of the feeding element 108 such that the parasitic element is electromagnetically charged.

The grounding system 102 can include a conductive housing of a wireless communication device and a ground slot structure 116. The grounding system 102 may include the chassis ground 102-2 disposed on a first surface of the wireless communication device, and a conductive housing 102-1 disposed on a second surface of the wireless communication device, wherein the second surface is perpendicular to the first surface. The ground slot structure 116 may include a metal clearance area composed of a non-conductive material such as plastic or an epoxy composite such as FR-4. As illustrated in FIG. 1, the triband antenna 104 may be disposed within the metal clearance area of the ground slot structure 116.

In some examples, the conductive housing 102-1 includes an opening 112 within a threshold distance of the triband antenna. For instance, the opening 112 (or "metal cut") may be located in a position such that an opening is in contact with the loop element 106 and chassis ground 102-2, but no other components of the triband antenna 104.

Each of the elements in the triband antenna 104 may be disposed within the metal clearance area in a particular manner. For example, the loop element 106 may be disposed within a threshold distance of the feeding element 108, such that the loop element 104 and the feeding element 108 may collectively generate a loop current within the triband antenna 104. For instance, the loop element 106 may also be a parasitic element, in that the loop element 106 is electromagnetically charged by virtue of its proximity to the feeding element 108. As described herein, the loop element 106 may be connected to the conductive housing 102-1 in order to create a closed loop shape.

Also, the loop element 106 may be disposed within a threshold distance of the feeding element 108, such that the loop element 106 and the feeding element 108 collectively generate a RF signal within a threshold range associated with GPS data transmission. For instance, the closed loop shape created by the loop element 106 coupled to the feeding element 108 may generate a loop current, which generates a loop radiation mode for a GPS band, such as around 1.575-1.61 GHz.

Similarly, the feeding element 108 may be disposed within the triband antenna 104 to generate a monopole radiation current at a first frequency. For instance, the feeding element 108 may itself generate a current for a monopole radiation mode, for instance in the 2.4-2.48 GHz range for 2.4 GHz Wi-Fi or Bluetooth transmission. Further, the loop element 106, the feeding element 108, and the parasitic element 110 may be disposed within the triband antenna 104 to generate a coupled monopole radiation current at a second frequency that is higher than the first frequency. For instance, the three elements may collectively generate different currents that are associated with 5 GHz Wi-Fi data transmission.

Figure 2:
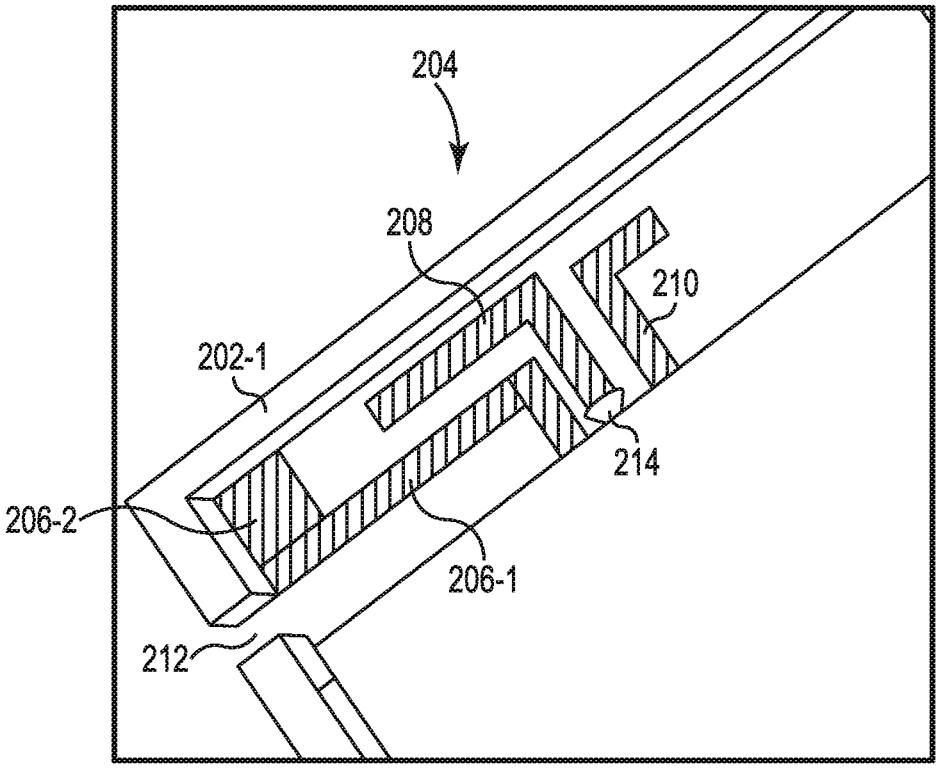
FIG. 2 illustrates a diagram of an example of a triband antenna apparatus according to the disclosure.

FIG. 2 illustrates a diagram of an example of a triband antenna apparatus 204 according to the disclosure. As mentioned, the triband antenna apparatus 204 may be included a smartphone, handheld computer, personal digital assistant, carputer, wearable computer, laptop, tablet computer, and/or laptop/tablet hybrids, etc.

The triband antenna apparatus 204 may include a loop element 206 of the triband antenna coupled to a conductive housing 202-1 of a wireless communication device to generate a RF signal in a first frequency range. As illustrated in FIG. 2, the loop element 206 may comprise a loop transition element 206-2 and a main loop element 206-1. As used herein, a loop transition element refers to a portion of the loop element 206 that may be moved laterally (e.g., closer to or further away from the opening 212) in order to modify the perimeter length of the loop antenna. Put another way, the loop element may further include a configurable loop transition element to modify a perimeter length of a loop current created by the loop element. Further, the triband antenna apparatus 204 may include a feeding element 208 directly coupled to a RF signal source 214 to generate a RF signal in a second frequency range. For instance, as discussed in relation to FIG. 1, the feeding element 208 may itself send and receive signals for 2.4 GHz Wi-Fi or Bluetooth data transmission. Also, the triband antenna apparatus 204 may include a parasitic element 210 of the triband antenna located within a threshold distance of the feeding element 208 to in part generate a RF signal in a third frequency range. For instance, as discussed in relation to FIG. 1, the loop element 206 and the feeding element 208 may transmit data in a first part of a 5 GHz Wi-Fi or Bluetooth bandwidth, whereas the feeding element 208 and the parasitic element 210 may transmit data in a second part of a 5 GHz Wi-Fi or Bluetooth bandwidth.

In some examples, the first frequency range may be associated with GPS data transmission. Similarly, the second frequency range may be associated with 2.4 GHz W-Fi or Bluetooth data transmission. Further, the third frequency range may be associated with 5 GHz Wi-Fi transmission. However, all three elements may be involved in generating the 5 GHz Wi-Fi transmission. For example, the loop element and the feeding element collectively generate a RF signal in a first part of a 5 GHz Wi-Fi frequency range, and the feeding element and the parasitic element collectively generate a RF signal in a second part of the 5 GHz Wi-Fi frequency range. Put another way, the harmonic loop radiation mode current generated by the loop element 206 and the feeding element 208 may be in the range of 5.1-5.5 GHz, while the coupled monopole radiation mode current generated by the feeding element 208 and parasitic element 210 may be in the range of 5.5-5.8 GHz. Together, the triband antenna may generate a wide bandwidth from 5.1 GHz to 5.8 GHz for Wi-Fi operations.

Figure 3:
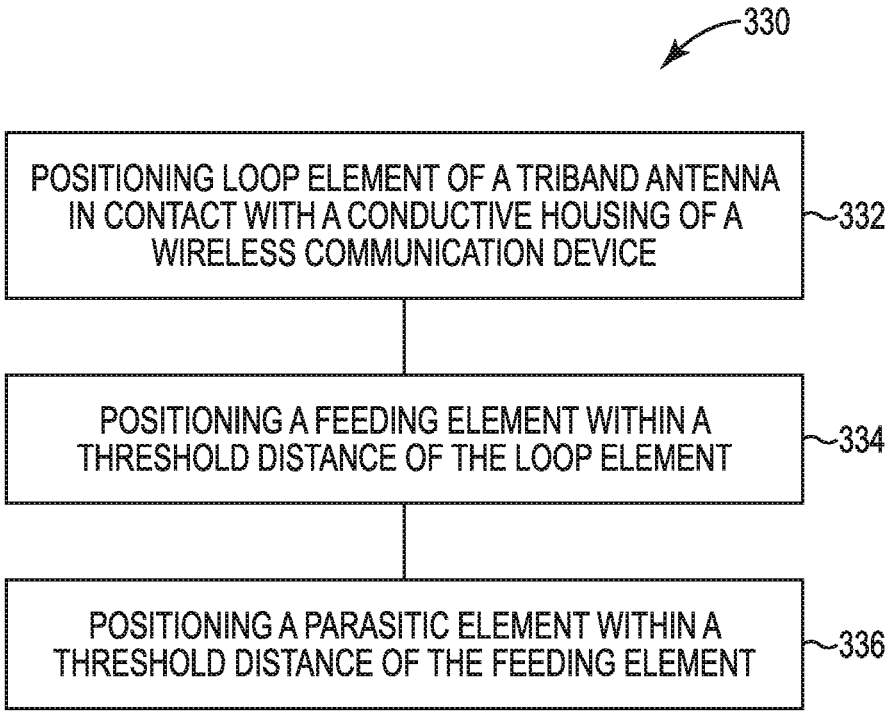
FIG. 3 illustrates a flow diagram of an example of a method of formation of a triband antenna according to the disclosure.

FIG. 3 illustrates a flow diagram of an example of a method 330 of formation of a triband antenna according to the disclosure. As illustrated at 332, the method 330 can include positioning loop element of a triband antenna in contact with a conductive housing of a wireless communication device. As used herein, positioning can include manufacture of and/or otherwise procuring the loop element. As mentioned, the loop element is to receive and transmit signals in a first frequency band.

The method 330 can include positioning a feeding element within a threshold distance of the loop element, as illustrated at 334. As illustrated in FIGS. 1 and 2, the feeding element may be isolated from the conductive housing by a nonconductive material such as plastic or an epoxy composite such as FR-4.

As illustrated at 336, the method 330 can include positioning a parasitic element within a threshold distance of the feeding element. As illustrated in FIGS. 1 and 2, the parasitic element may be isolated from the conductive housing by the nonconductive material.

As discussed in relation to FIG. 2, the method 330 may also include defining a length of a circumference of a loop current generated by the loop element, and defining a length of the feeding element such that the loop element and the feeding element collectively generate a radio frequency signal in a first part of a 5 GHz Wi-Fi frequency range. That is, the loop element of the triband antenna may be tuned by adjusting the position of the loop transition element, independent of the feeding element and the parasitic element. Similarly, the feeding element may be tuned by adjusting the length of the feeding element, independent of the loop element and the parasitic element. Moreover, the parasitic element may be tuned by adjusting the length of the parasitic element, independent of the loop element and the feeding element. Put another way, each element of the triband antenna may be independently tuned to transmit and receive RF signals within a particular frequency and/or frequency range, by adjusting the length and/or position of the element without modifying the remaining elements. To that end, the method 330 may include defining a length of the feeding element, and defining a length of the parasitic element such that the feeding element and the loop element collectively generate a radio frequency signal in a second part of a 5.0 GHz Wi-Fi frequency range.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. For example, reference numeral 110 may refer to element "10" in FIG. 1 and an analogous element may be identified by reference numeral 210 in FIG. 2. Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense.

As used herein, "a number of" an element and/or feature can refer to one or more of such elements and/or features. It is understood that when an element is referred to as being "on," "connected to", "coupled to", or "coupled with" another element, it can be directly on, connected to, or coupled with the other element or intervening elements may be present. As used herein, "substantially" refers to a characteristic that is close enough to the absolute characteristic to achieve the same functionality (e.g., having three respective antenna (first antenna, second antenna, and third antenna) each positioned substantially at respective corners of an electronic device to create physical separation (i.e., distance) between each of the three antenna to achieve high antenna isolation).

What is claimed:

1. A system, comprising:

a grounding system including a conductive housing of a wireless communication device and a ground slot structure; and a triband antenna coupled to the grounding system, wherein the triband antenna includes:

a loop element coupled to the conductive housing;

a feeding element; and a parasitic element located within a threshold distance of the feeding element.

2. The system of claim 1, wherein:

the ground slot structure includes a metal clearance area composed of a non-conductive epoxy composite; and the triband antenna is disposed within the metal clearance area.

3. The system of claim 1, wherein:

the loop element is disposed within a threshold distance of the feeding element; and the loop element and feeding element collectively generate a loop current within the triband antenna.

4. The system of claim 1, wherein:

the loop element is disposed within a threshold distance of the feeding element; and the loop element and feeding element collectively generate a radio frequency signal within a threshold range associated with global positioning system data transmission.

5. The system of claim 1, wherein the feeding element is disposed within the triband antenna to generate a monopole radiation current at a first frequency.

6. The system of claim 5, wherein the loop element, the feeding element, and the parasitic element are disposed within the triband antenna to generate a coupled monopole radiation current at a second frequency that is higher than the first frequency.

7. A triband antenna apparatus, comprising:

a loop element of the triband antenna coupled to a conductive housing of a wireless communication device to generate a radio frequency (RF) signal in a first frequency range;

a feeding element of the triband antenna directly coupled to a RF signal source to generate a RF signal in a second frequency range; and a parasitic element of the triband antenna located within a threshold distance of the feeding element to in part generate a RF signal in a third frequency range, wherein:

the loop element and the feeding element collectively generate a RF signal in a first part of a 5 gigahertz (GHz) Wi-Fi frequency range; and the feeding element and the parasitic element collectively generate a RF signal in a second part of the 5 GHz Wi-Fi frequency range.

8. The apparatus of claim 7, wherein the loop element includes a configurable loop transition element to modify a perimeter length of a loop current created by the loop element.

9. The apparatus of claim 7, wherein first frequency range is associated with global positioning service (GPS) data transmission.

10. The apparatus of claim 7, wherein the second frequency range is associated with 2.4 gigahertz (GHz) Wi-Fi or Bluetooth data transmission.

11. The apparatus of claim 7, wherein the third frequency range is associated with 5 gigahertz (GHz) Wi-Fi data transmission.

12. A method of manufacture of a triband antenna, comprising:

positioning a loop element of a triband antenna in contact with a conductive housing of a wireless communication device;

positioning a feeding element within a threshold distance of the loop element, wherein the feeding element is isolated from the conductive housing by a nonconductive material;

positioning a parasitic element within a threshold distance of the feeding element, wherein the parasitic element is isolated from the conductive housing by the nonconductive material defining a length of a circumference of a loop current generated by the loop element; and defining a length of the feeding element such that the loop element and the feeding element collectively generate a radio frequency signal in a first part of a 5 gigahertz (GHz) Wi-Fi frequency range.

13. The method of claim 12, further comprising:

defining a length of the feeding element; and defining a length of the parasitic element such that the feeding element and the loop element collectively generate a radio frequency signal in a second part of a 5.0 gigahertz (GHz) Wi-Fi or Bluetooth frequency range.

* * * * *